US005562111A

United States Patent [19]

Torres

[11] Patent Number: 5,562,111

[45] Date of Patent: Oct. 8, 1996

[54] HAIR HILIGHTING CAP

[76] Inventor: Ana M. Torres, 3821 W. Franklin Ave. Apt. 6, Fullerton, Calif. 92633

[21] Appl. No.: 363,349

[22] Filed: Dec. 23, 1994

[51] Int. Cl.[6] ..... A45D 19/18

[52] U.S. Cl. ..... 132/270; 132/54; 132/212

[58] Field of Search ..... 132/270, 54, 212

[56] References Cited

U.S. PATENT DOCUMENTS

| | | | |
|---|---|---|---|
| Re. 30,305 | 6/1980 | Caruso | 132/270 |
| 3,304,945 | 2/1967 | Anderson | 132/270 |
| 5,042,511 | 8/1991 | Haddad | 132/270 |

*Primary Examiner*—Gene Mancene
*Assistant Examiner*—Pedro Philogene
*Attorney, Agent, or Firm*—Cleveland R. Williams; James D. Thackrey

[57] ABSTRACT

Apparatus for hairdressers to use in coloring multiple, localized and isolated strands of hair, called highlighting. The task is made easier and the product better by making dozens of parts in the hair, extracting a few locks or strands along the length of each part, storing these selected strands between sheets of plastic film, and only then applying the color-imparting chemicals. The structure of the cap, by design, makes this procedure easy and straightforward for the first time.

2 Claims, 1 Drawing Sheet

HAIR HILIGHTING CAP

BACKGROUND OF THE INVENTION

1. Field of the Invention

In the hairdressing art portion of beauty parlors it is often desired to cause the hair to exhibit two colors, a process called by several names such as tinting, frosting, or highlighting. This invention comprises a novel and useful cap to be used by the hairdresser to expedite the process of coloring localized strands or bunches of hair in an orderly pattern so as to enhance the overall effect on an observer of hair which has been subjected to localized re-coloring.

2. Description of Prior Art

There are two caps currently used for what hairdressers call highlighting or frosting, to assist the hairdresser in producing the desired effect.

One product is a full cap to be tightly fitted over all the area from which hair grows. Holes are provided essentially all over the surface of the cap, which is placed over combed-back hair. The strands to be colored are drawn through the holes with a tiny hook inserted in each hole, capturing a tiny lock of hair which is then pulled through the cap and becomes the strand to be colored. This type of cap allows the treating chemical to be applied at the same time, approximately, to all the strands to be colored—avoiding both undercoloring and excessive exposure to the chemical which can damage the hair. It's principal disadvantage is that the strands pulled through the cap need not extend to their roots. Depending on the time, patience and skill of the hairdresser's blind manipulation of the tiny hook, the hair pulled through can come from any depth and/or a location on the scalp dependent on the parallelism of individual hairs generated by the pre-combing and, in theory, retained during installation of the cap. Hairs from an upper layer might originate an inch or more distant from the hole, or a smaller distance sideways. Moreover, backsliding the length of a strand of hair against the combed direction of adjacent hairs may disturb the orderliness of hair "downstream" from the hole being worked on. The result in any case is some discomfort to the customer, more discomfort and disorderliness than my invention provides.

Another device for doing the same localized strand-coloring is a stack of special-purpose self-adhesive wraps in the form of sheets and a "helper," a rectangular flat made of plastic on which one sheet is to be laid for each line of strands to be colored. A substantially horizontal line is created in the hair mass, with the helper's narrow end close to the scalp and the hair above temporarily directed upward except for the strands to be treated, which lie in the long direction of the helper on which one sheet of the self-adhesive wrap lies. The chemical is applied, the wrap doubled over enclosing chemical and hair strands and sealed to itself, and the helper removed. The entire process is then repeated a fraction of an inch higher on the head, and again and again to cover the back and sides of the head. The duration of manipulation is a serious drawback to this method, since exposure of hair strands to chemical varies so much at various placed on the head. It is a slow process with considerable danger of overprocessing or undercoloring local regions. Damage to the hair, or variability of result over the head are the principal drawbacks to the use of wraps to color hair locally. My invention accomplishes the same end without such drawbacks, as the hair preparation time is divorced from the time span in which the hair is exposed to chemicals.

SUMMARY OF THE INVENTION

My invention is a one-piece cap to go on a head of hair to be partially re-colored in isolated strands. That is, isolated local strands, located pretty well all over the head, are to be converted by application of chemicals to contrast with the natural hair color. The overall effect is whatever the customer wants in terms of percentage re-colored and amount of color contrast—the cap merely expedites the doing of the hairdresser's job.

Physically the cap covers the head in the manner of a bathing cap but with substantial differences in structure. A great deal of the surface area is open, to allow handling access and to provide ports through which the hair to be left uncolored protrudes. A framework of support bands, like relatively thick but narrow and flexible ribbons, confers durability and a certain amount of stiffness to the entire cap, and divides the head into roughly rectangular zones which are independent and can be treated one by one. Perhaps six zones exist (left side lower portion, left side upper portion, etc.).

Spanning from side to side of the roughly rectangular zones are narrow strut members carrying wing members. Both have a row of perforations along the length direction; both are of chemical-resistant plastic. The strut members are narrow and thin ribbons spaced roughly parallel to each other, attached at their ends to framework members. The wing members are attached to the strut members and consist of double sheets of thin plastic film on which, between the doubled sheets, the hair strands to be colored lie (separated and isolated from the rest of the hair). These strands are pulled through the perforations and lie between the halves of one folded wing, ready for application of the chemical to the strands alone. The hairdresser uses a comb with short teeth to reach between strut members and part the hair beneath each strut member, one part at a time, to ensure all chemical reaches as close as feasible to the hair roots.

DESCRIPTION OF THE PREFERRED EMBODIMENTS

The drawings may be interpreted as showing two embodiments, the choice between the two dependent on factors other than invention. One has crossmembers in the framework Item 1 solely for durability upon repeated use and is chosen, rather arbitrarily, as the preferred embodiment. Eliminating these extraneous cross-members, (Item 3 spacing members) produces a hair tint cap easier to use in that the head area (that part of it which would have lain beneath Items 3) becomes available for combing the hair, much of which is required since dozens of "parts" are to be made by the hairdresser. Moreover, the perforated backing strips Item 6 serve to space the framework support bands, Item 2 as well as to isolate the strands to be colored. Since they span the zones and help in anchoring the support bands, perforated backing strips 6 may give sufficient ruggedness to the framework Item 1 that the spacing members 3 may be eliminated in an alternate embodiment.

Experience gained in the marketplace will determine whether more hairdressers prefer durability of the cap over convenience in use, or vice versa. Therefore, both are inventions, the more complex structure is described as being preferred, and the omission of one element (Item 3) is left to the imagination of those skilled in the art.

The framework Item 1 outlines (or circumscribes) the area on which scalp hair grows, down to the reverse curve where skull meets neck in the back, below the ear on the sides, and around the face in the front. Flexible plastic members, called support bands Item 2, lie along these lines, and include fastening means for securing the cap to the head. Those skilled in the art can employ their choice of fastening means; so many such means being prior art this element is not considered part of my invention. Tieing the ends of support bands 2 under the chin is illustrative only, velcro, buckles, hooks and snaps being such well developed alternatives as to be conventional, not inventive. It is also noted that replacing the flat ribbons shown with round cords, chains, and the like is an uninventive modification of my invention.

At least two additional support bands 2 pass from the front members of framework Item 1, over the top portion of the head, and are permanently attached to the rear members of the framework, forming at least three zones Item 4. These at least three zones are subdivided in the alternate embodiment into three large zones, and in the preferred embodiment into smaller zones by spacing members 3. Spacing members 3 are similar in structure to the framework outlining members support bands Item 2 (which appear in both embodiments), they may be of other structure such as of circular cross section. In any case their terminations at the framework outline are permanent, and the Zones 4 they create fixed zones which exist in any embodiment.

Figure 3:
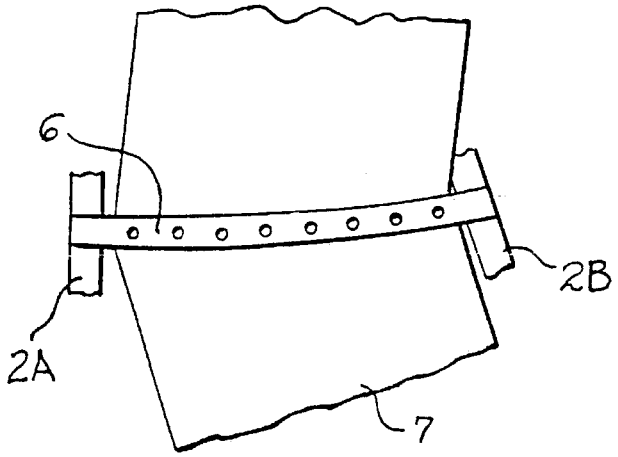
FIG. 3 is a perspective view of the strut member and wing member only, showing these items as they would exist permanently attached to support bands on opposing sides of a zone in the preferred embodiment.
Figure 2:
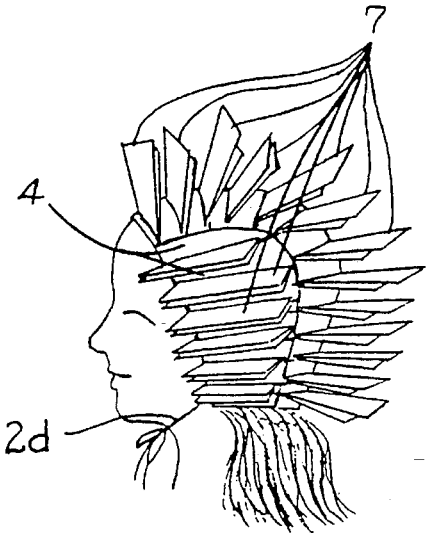
FIG. 2 is similar to FIG. 1 except that the customer's hair is in condition to receive the chemical.

Geometrically Zones 4 may be considered to have four sides as does a rectangle, even though a single curving support band 2 may form two of the sides. Thus opposite sides of zones may be spoken of. Strut members 5 span generally horizontally across the zones from opposite side to opposite side, where they are permanently attached. Strut members 5 consist of perforated backing strip 6 and it's associated wing member 7, which contains matching perforations across the center of Item 7's generally elongated rectangular plan view where it is permanently attached to backing strip 6. Wing members 7 are of plastic film less than 0.005 inch thick in the preferred embodiment, and strut members 5 a few thousandths thicker. Strut members 5 further subdivide the zones into open strips as shown in FIGS. 2 and 3. The strips in the preferred embodiment ideally are roughly ½ inch wide and 3 inches long, although the various actual open strips vary substantially from the ideal. This gives openings of sufficient size and shape to allow the hairdresser to manipulate the hair so as to form a part beneath each strut member and to pull through its perforations a row of the desired size strands. The strands now being isolated physically between the two ends of the wing member 7, chemical can be placed on the selected strands only.

Figure 1:
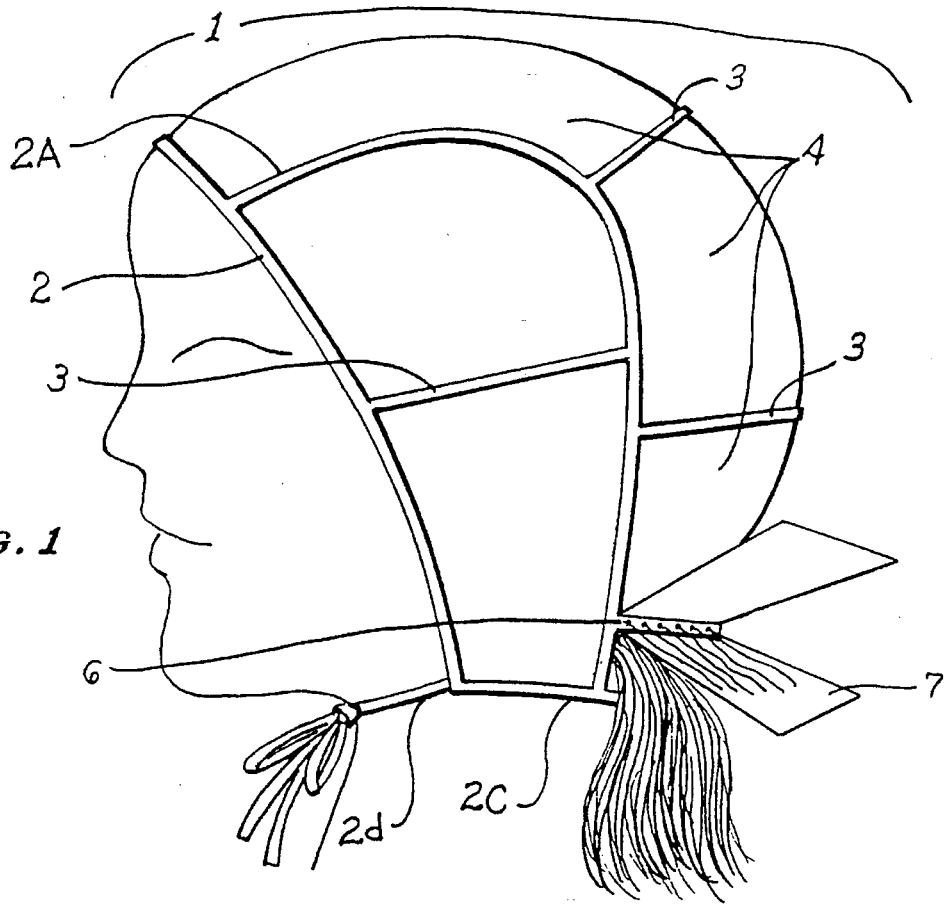
FIG. 1 is a side view of only the structural portions of the invention, in place on a customer's head. Only one typical strut member and its related wing member are shown; otherwise those parts would obscure the structural portions.

As previously stated, an alternate embodiment containing all the above except support bands 2 is invented and works the same way. It is illustrated in FIG. 1 if one omits Items 3, and in FIG. 2.

The invention having been described above, it is clear that modifications can be made by those skilled in the art without exercise of the inventive faculty. Accordingly, the scope of this invention is considered to be defined by the scope of the following claims:

I claim:

1. A cap for use in changing the color of multiple strands of human hair in an ordered fashion, comprising:

A framework of support bands, constructed of plastic ribbon extending around the face and fastened securely under the chin, branching both around the neck to the opposite side of said framework and having two branches both extending across the top of the head and down the back of the head to attach to the plastic ribbon going around the neck, and having spacing members to form said framework into a net isolating zones to be treated all over the head, and strut members within each said zone of said framework extending from side to side across said zone, and comprising a perforated backing strip perforated the full length of said strut member with perforations through which strands of hair can be pulled and wing members having a width the length of said strut member, and a length greater than twice that of the hair to be colored, attached at a midpoint to said perforated backing strip, and having perforations in the same pattern as does said perforated backing strip, and resistant to coloring chemicals;

whereby strands of hair emerging from perforation in said perforated backing strip may be isolated from other hair on the head while being exposed to a coloring chemical.

2. A cap for use in changing the color of multiple strands of human hair in an ordered fashion, comprising:

a framework of support banks, constructed of plastic ribbon extending around the face and fastened securely under the chin, branching both around the neck to the opposite side of said framework and having two branches both extending across the top of the head an down the back of the head to attach to the plastic ribbon going around the neck, and strut members within each said zone of said framework extending from side to side across said zone, and comprising a perforated backing strip perforated the full length of said strut member with perforations through which strands of hair can be pulled; and wing members having a width the length of said strut member, and length greater than twice that of the hair to be colored, attached at a midpoint to said perforated backing strip, and having perforations in the same pattern as does said perforated backing strip may be isolated from other hair on the head while being exposed to a coloring chemical.

* * * * *